United States Patent [19]

Colvin

[11] Patent Number: 4,545,171

[45] Date of Patent: Oct. 8, 1985

[54] PREFABRICATED FOLDING STRUCTURE

[75] Inventor: Harry Colvin, Barnegat, N.J.

[73] Assignee: Shanni International, Inc., Freehold, N.J.

[21] Appl. No.: 491,815

[22] Filed: May 5, 1983

[51] Int. Cl.[4] ..... E04B 1/344

[52] U.S. Cl. ..... 52/79.5; 52/71

[58] Field of Search ..... 52/22, 79.5, 79.1, 90, 52/68, 64, 69, 71

[56] References Cited

U.S. PATENT DOCUMENTS

| | | | |
|---|---|---|---|
| 2,793,067 | 5/1957 | Couse | 52/68 X |
| 2,920,920 | 1/1960 | Couse et al. | 52/68 X |
| 3,107,116 | 10/1963 | Meaker | 52/68 X |
| 3,348,344 | 10/1967 | Tatevossian | 52/22 |
| 3,376,676 | 4/1968 | Tatevossian | 52/90 |
| 3,501,875 | 3/1970 | deMailly | 52/79.5 X |
| 3,557,500 | 1/1971 | Schmidt et al. | 52/69 |
| 3,638,373 | 2/1972 | Chapman | 52/79.5 X |
| 3,857,211 | 12/1974 | Sharpton | 52/68 |
| 4,070,804 | 1/1978 | Van der Lely | 52/79.5 X |

FOREIGN PATENT DOCUMENTS

| | | | |
|---|---|---|---|
| 574311 | 3/1958 | Italy | 52/68 |
| 674946 | 7/1952 | United Kingdom | 52/79.5 |
| 761276 | 11/1956 | United Kingdom | 52/68 |
| 1356242 | 6/1974 | United Kingdom | 52/79.5 |

OTHER PUBLICATIONS

W. G. Blair, "Factory-Built House Unfolds on Site" N.Y. Times Real Estate Section, Sunday Jan. 20, 1980, pp. 1-4.

*Primary Examiner*—J. Karl Bell

*Attorney, Agent, or Firm*—Pennie & Edmonds

[57] ABSTRACT

A prefabricated structure, illustratively a residential dwelling, having a prefabricated central core and a plurality of prefabricated floor, wall and roof members that pivotally fold inwardly about the central core to produce a compact partially collapsed folded structure, which is easily transportable, and pivotally fold outwardly about the central core for quick and inexpensive on-site installation, is disclosed.

20 Claims, 16 Drawing Figures

PREFABRICATED FOLDING STRUCTURE

BACKGROUND OF THE INVENTION

1. Field of the Invention

The invention relates to prefabricated structures, illustratively residential dwellings, which have a prefabricated central core and are comprised of a plurality of prefabricated floor, wall and roof members that fold inwardly about the core to produce a compact partially collapsed folded structure, which is easily transportable, and fold outwardly from the core for quick and inexpensive on-site installation.

2. Background of the Invention

Over the years, the vast majority of structures, particularly residential houses, were completely constructed on-site. Specifically, once a suitable building lot has been chosen by a prospective home owner or developer, the lot was sufficiently cleared to accommodate a suitable foundation for the home. Shortly thereafter, construction proceeded through a sequence of stages. For each stage to occur, necessary materials and skilled labor were brought to the site. For example, after the foundation was laid, the shell of the house was constructed by a team of carpenters which cut to length and appropriately nailed together a requisite number of standard dimension wooden studs, illustratively 8, 10 or 12 foot sections of 2"×4" or 2"×6" studs. Thereafter, exterior wall and roof sheathing, and interior sub-floors were installed using appropriately sized plywood sheets, followed by the installation of exterior siding and roof shingles. Simultaneously therewith, the windows and the heating, electrical and plumbing systems were installed by carpenters, heating contractors, electricians and plumbers, respectively. Insulation was then added to the structure followed by the installation of all the interior walls and floors. Thereafter, the necessary appliances were put in position and connected to the appropriate electrical and plumbing systems. This, in turn, was illustratively followed by all remaining interior work such as painting, wall-papering, installation of interior trim and the like and any external landscaping.

While complete on-site construction, in a manner typified by that described above, has been the predominant form of house construction, construction costs, noteably labor, have substantially increased during the past two decades to the point where a significant number of buyers can no longer afford the price of a new house.

Consequently, various alternatives have been put forth in the art aimed at providing economically priced housing. In general, these alternatives all involve prefabricating various portions of a house at a central facility or plant by resident teams of skilled labor, transporting these portions to a building site and then performing the remaining assembly work on-site. It was generally thought that by prefabricating all or a significant portion of a house, sufficient cost savings would occur so that the purchase price of the installed prefabricated house would be advantageously less than that of a similarly sized conventionally constructed house. However, for a variety of reasons, the installation cost of each of these prefabricated prior art structures was substantial and, when added to the cost of manufacture and delivery, caused the total cost of any of these prefabricated structures to exceed that of conventional construction.

One such prior art prefabricated structure is described in U.S. Pat.No. 3,501,875 (issued to J. J. de Mailly on Mar. 24, 1970). This house is comprised of a number of rooms whose walls have been prefabricated from stressed concrete. Each room is nested inside another, to form two groups of nested rooms which are then loaded onto a flat-bed truck for the shipment to a building site. During on-site installation, a crane lifts each room from its nested group and appropriately positions it on a floor which has been attached to a suitable foundation. The rooms are then attached to each other. Thereafter, a prefabricated roof is laid in place over all the positioned rooms.

A house of this type carries a significant installation cost for the following illustrative reasons. First, since wiring and plumbing cannot be run within concrete walls, this necessitates that the rooms be electrically wired and plumbed at the time of on-site installation. In addition, nesting prevents any closets from being installed in any room until after the house has been installed on-site. Furthermore, any foundation used to support this house must be sufficiently strong to support its substantial weight and is thus usually fabricated from reinforced concrete which is quite expensive. Lastly, since a prefabricated house of the type described in the '875 patent is not self-supporting, steel columns or pillars are incorporated into the walls in order to support the weight of the roof. Unfortunately, steel columns are not standard in residential construction and hence, further increase the cost of the house.

Another approach was disclosed in U.S. Pat. No. 3,348,344 (issued to L. Tatevossian on Oct. 24, 1967). There, the prefabricated house is comprised of a prewired and plumbed central core surrounded on each of two sides by a number of folding rooms which share a common end wall that rides along a track. Each room contains two side walls connected at one end to a respective end wall and at the other end to the central core. Each side wall has a full-height hinge which collapses the wall with accordian-like folds. For shipping, the walls and floors are all folded inwardly towards the central core, and the roof sections of the house are folded down around the folded walls. During installation, the house is first positioned on a suitable foundation. The roof sections are first raised and the floor is then extended. Thereafter, to unfold the house, each end wall is pulled outwardly on its track from the central core and is then secured in place at the end of its travel.

While the installation cost of this folding structure is less than that associated with the structure disclosed in the '875 patent, it is still too large, for the illustrative reasons indicated below, to make the house described in the '344 patent economically viable over a similarly sized conventionally constructed house. Specifically, because of the substantial weight supported by each end wall and the large amount of friction between each end wall and the track in which it rides—particularly if dirt enters the track, a substantial amount of effort is required to fully extend each end wall away from the central core. Hence, a bulldozer or other heavy equipment must be procured, usually by renting at a fairly significant cost, for use in extending these walls away from the core. Furthermore, the accordian-like folds, in the rooms surrounding the central core, prevent any closets from being located anywhere but in the central core. Consequently, this severely limits available closet space, and thus necessitates that any additional closets be constructed on-site. In addition, this house is primarily constructed from aluminum, which is a non-standard and expensive building material. While unrelated to cost, this prefabricated house possesses an additional drawback in that it has a relatively high center of gravity, which disadvantageously makes the house, when folded, readily susceptible to tipping over.

SUMMARY OF THE INVENTION

Accordingly, an object of this invention is to provide a low-cost prefabricated structure which is not only economical to manufacture but is also easy and inexpensive to install on-site, and which thereby provides significant cost savings over a similarly sized conventionally constructed structure.

A particular object is to install all the necessary systems—e.g. wiring, plumbing and heating, and appliances in the structure during prefabrication.

Another particular object is to minimize the need for any heavy machinery during installation of the structure.

A further particular object is to eliminate the need for any non-standard building materials.

A further particular object is to minimize the weight of the structure thereby eliminating the need for both internal columns and a reinforced foundation.

Another further particular object is to minimize the labor and effort required for installation.

Lastly, another object is to incorporate as much stability as possible into the structure in order to minimize the tendency of the structure to tip-over while it is being transported.

These and other objects are achieved in accordance with the invention by a folding structure essentially comprised of a central core having at least two oppositely arranged interior wall members, and a plurality of structural members each of which is pivotedly connected at its ends to a corresponding one of the interior wall members or to a pre-selected one of the structural members so as to form either a compact folded structure, wherein said structural members are pivotedly positioned inwardly about the central core so as to lie in close proximity to and substantially parallel to the corresponding interior wall members, or a sturdy habitable structure, wherein the structural members are pivoted outwardly from the central core so as to define a plurality of rooms arranged about the central core.

Since the weight of the folding structure is primarily supported by the walls comprising the central core, relatively little weight is borne by any of the folding wall, floor and ceiling members. Consequently, these folding members can be made fairly light in weight. Not only does this advantageously eliminate the need to use a reinforced foundation, but, in addition, this advantageously minimizes the effort required to pivotally move these members into proper position during installation of the structure. Thus, once the structure is properly positioned on its foundation, only a minimum amount of labor and no heavy machinery is needed to unfold the structure and complete the installation. These factors, coupled with the use of only inexpensive standard building materials and extensive prefabrication, advantageously permit substantial cost savings to be achieved over the cost of both prior art prefabricated structures and conventional construction.

Specifically, in accordance with a specific embodiment disclosed herein, all the necessary residential systems for the entire structure, e.g. heating, plumbing and electrical, and all the required appliances and plumbing fixtures are installed in the central core at the time of its prefabrication. Furthermore, any outlets that are to be located in any of the folding members, particularly the walls, are installed while the structure is being prefabricated.

In accordance with a feature of this invention, substantial closet space is incorporated into the folding structure through the use of folding interior walls and free-standing partitions. When the structure is fully folded, these interior walls and partitions are initially positioned to lie alongside various interior side walls comprising the central core. Once the walls and floor members are pivoted into their properly installed positions, an enclosed area is defined around the core. Each interior folding wall and each free-standing partition are then pivoted or moved to a pre-determined position within this area in order to define all the rooms arranged about the core and all the closets existing therein.

In accordance with another feature of this invention, multi-story structures can be readily fabricated by stacking separate folding structures. Specifically, a two-store structure can be easily built by installing and completely unfolding one, i.e., a lower, folding structure, on-site, and then placing another, i.e., an upper, folding structure, with a folding roof, directly on top of the lower structure and then completely unfolding the upper structure. In this arrangement, ceiling rafters of the lower structure lie directly below floor joists of the upper structure. During prefabrication, appropriate openings are framed in the ceiling of the lower structure and in the floor of the upper structure to accommodate a staircase, which is then installed in the lower structure during prefabrication. The number of separate structures that can be stacked, i.e., the number of stories in the resulting dwelling, is essentially determined by the weight of each structure, and the amount of weight that can be supported by each structure and by the foundation.

BRIEF DESCRIPTION OF THE DRAWING

The invention may be clearly understood from a consideration of the following detailed description and accompanying drawing.

In all the cross-sectional views indicated below, which depict the folding structure in various stages of being unfolded, each cross-sectional view has been taken along a section generally similar to that shown by lines 2—2 of FIG. 10.

The drawing is comprised of the following figures:

FIG. 1 is a perspective view of the outside of applicant's prefabricated folding structure shown in a completely folded shipping configuration;

FIG. 2 is a cross-sectional view of applicant's prefabricated folding structure shown in FIG. 1;

FIG. 3 is a cross-sectional view of pivot 2 shown in FIG. 2 and taken through section 3—3 of FIG. 8;

FIG. 4 is a partial cross-sectional view of one of pivots 3 shown in a folded position and taken through section 4—4 of FIG. 7;

Figure 5:
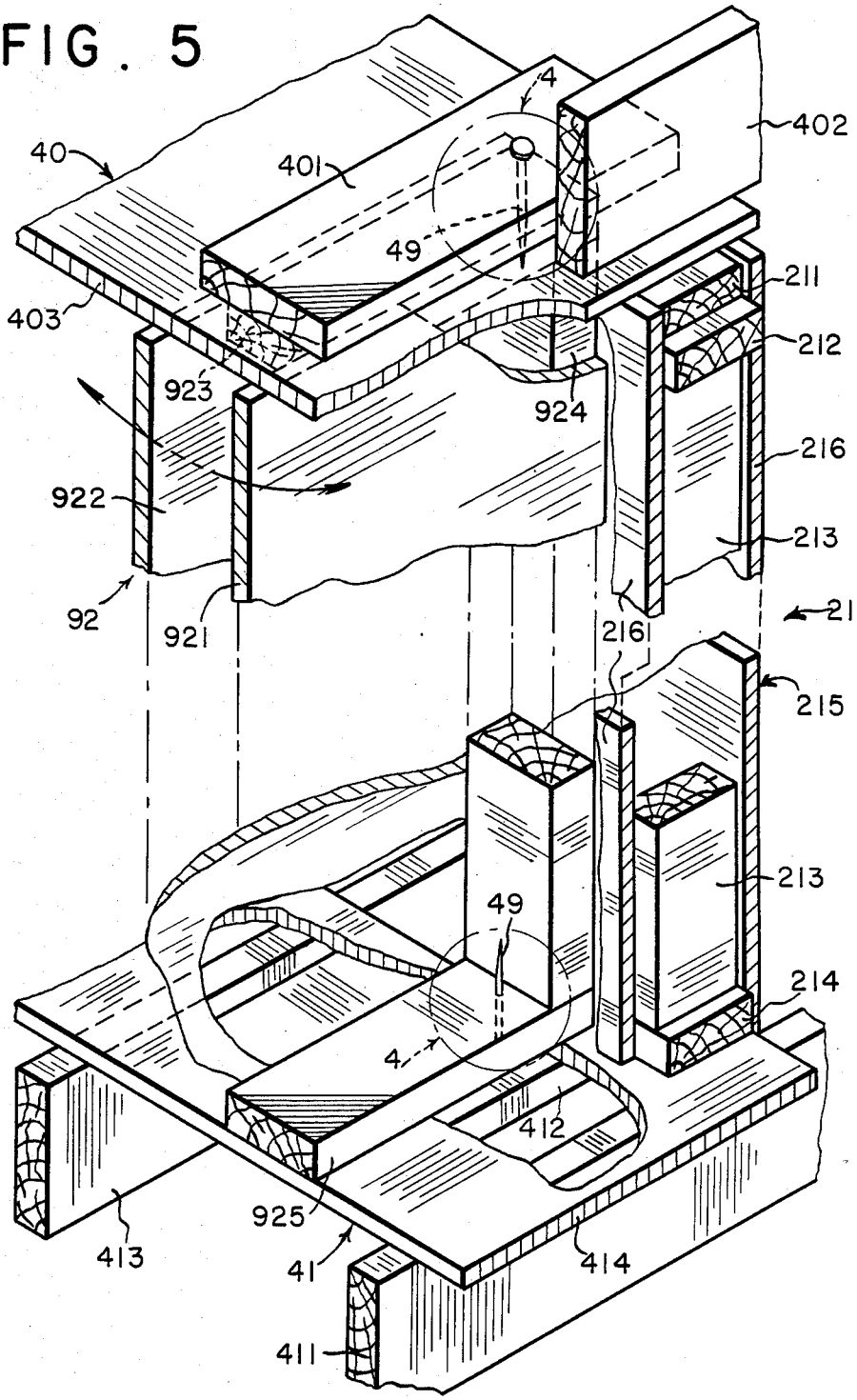
Figure 6:
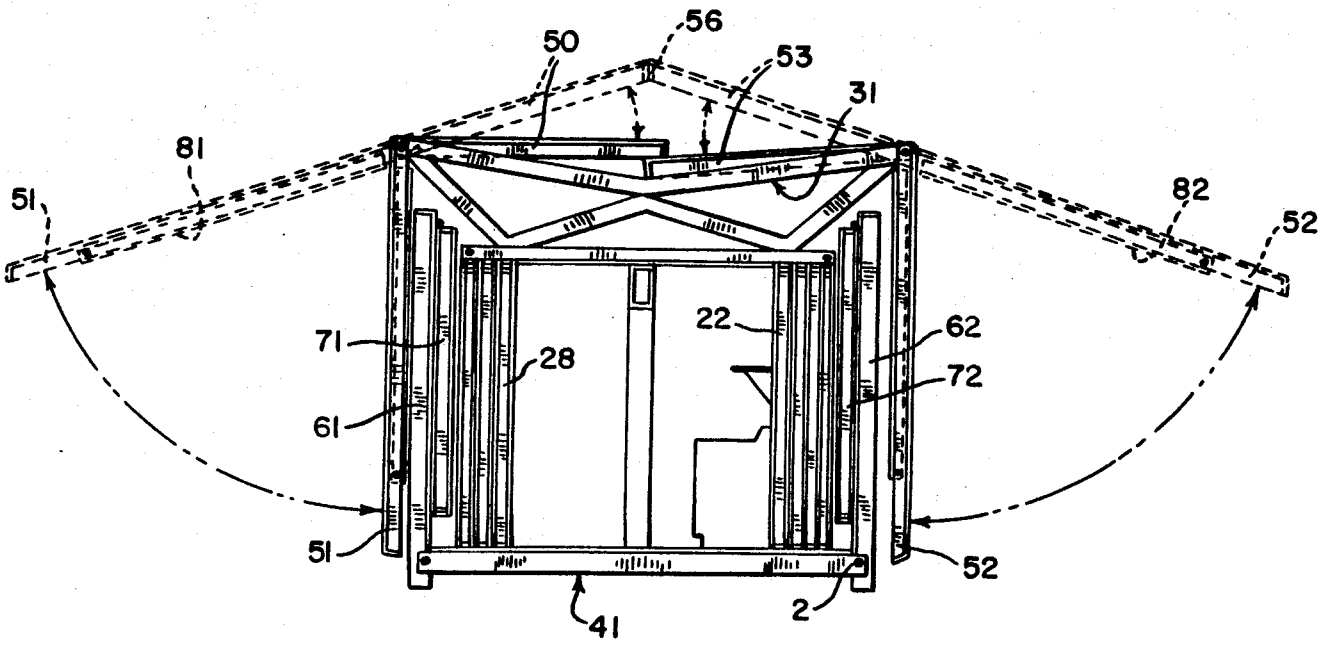
Figure 7:
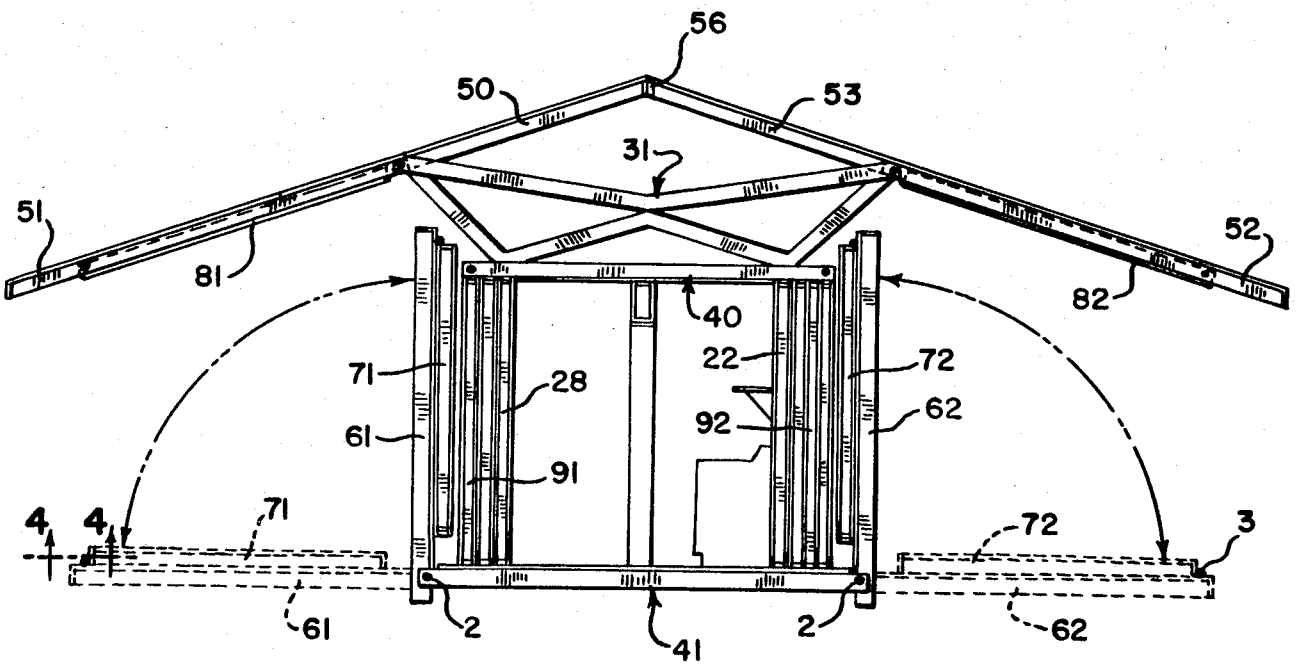
Figure 8:
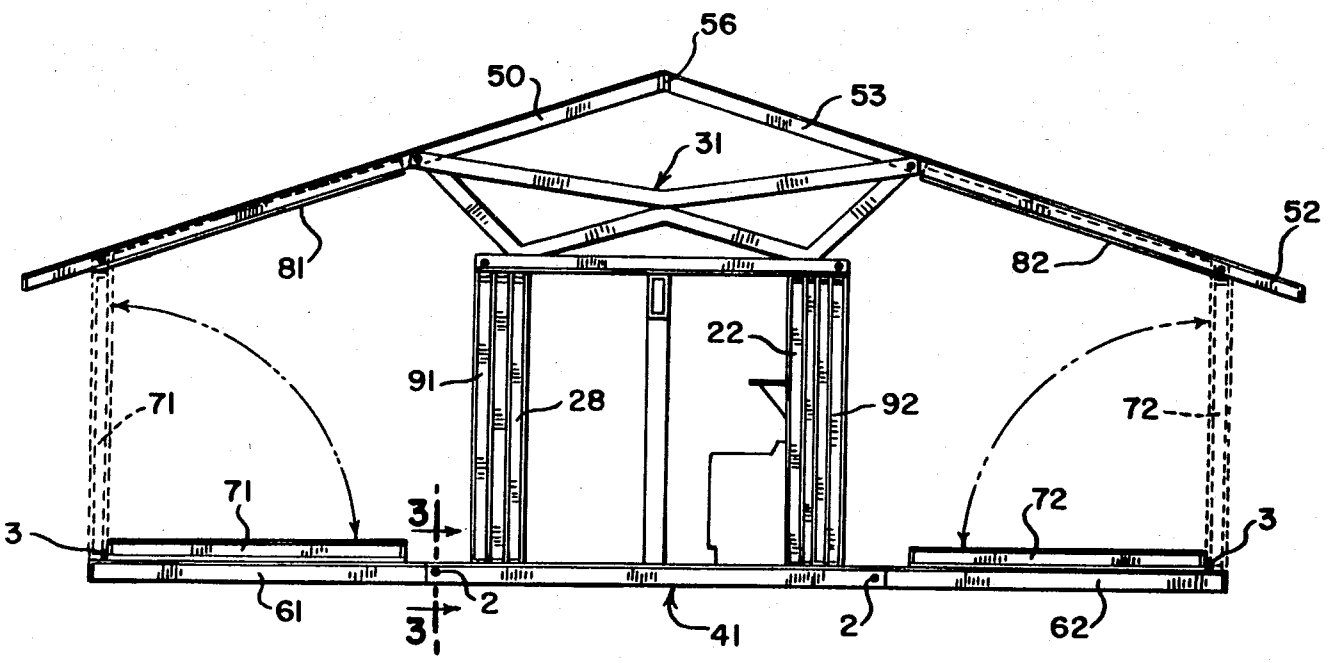
Figure 9:
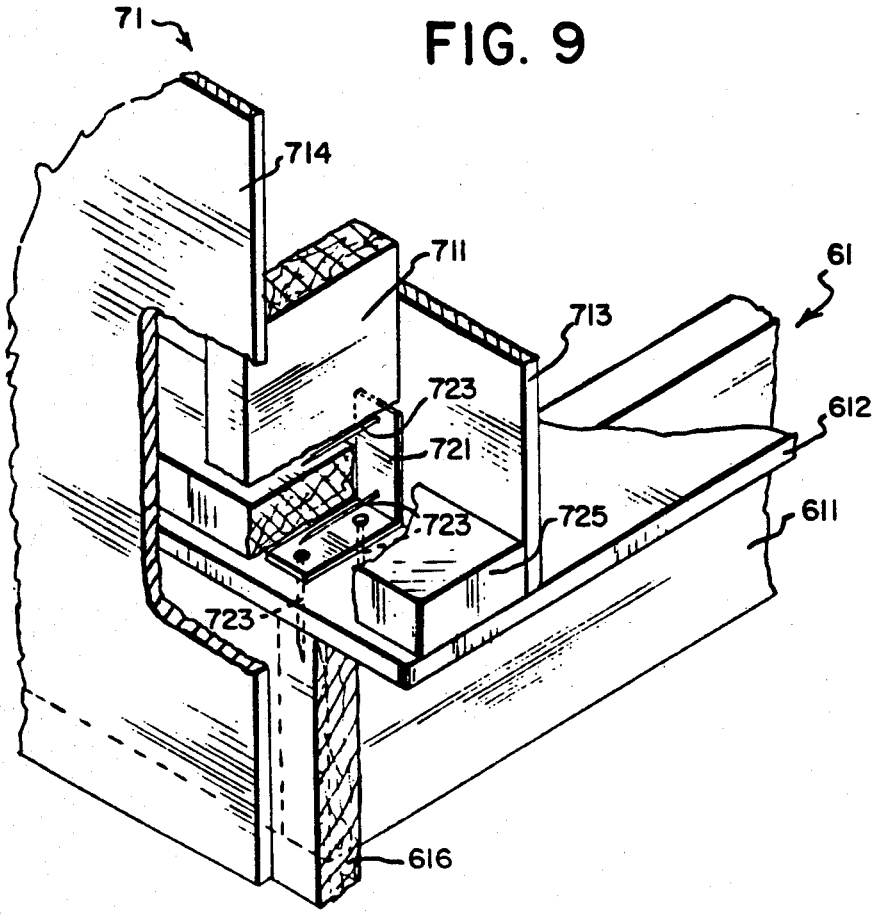
Figure 10:
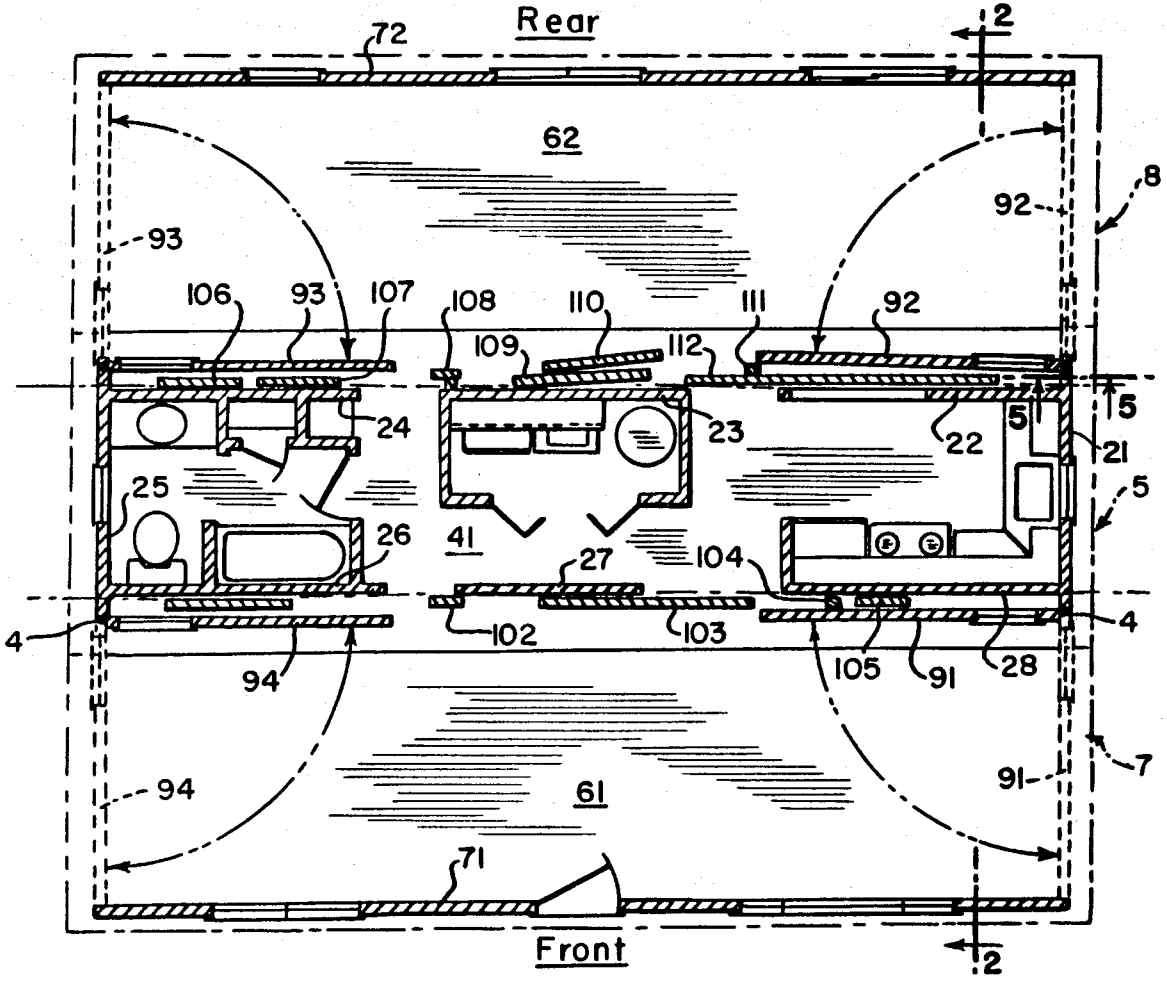
Figure 11:
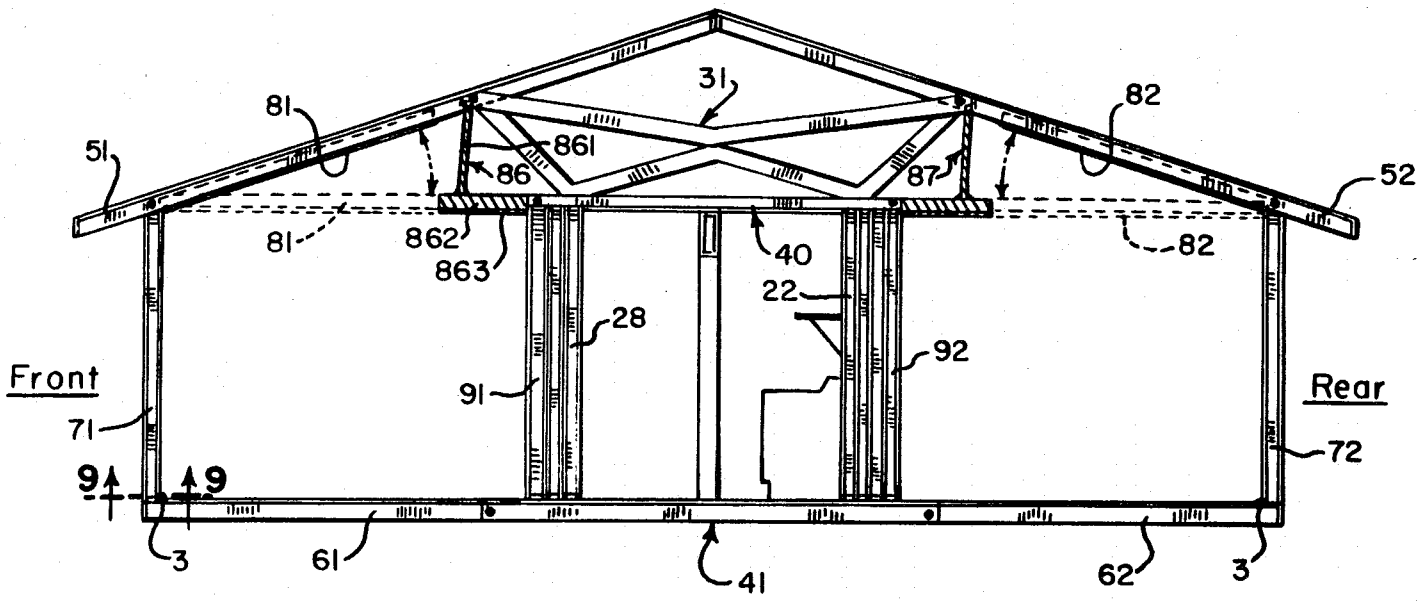
Figure 12:
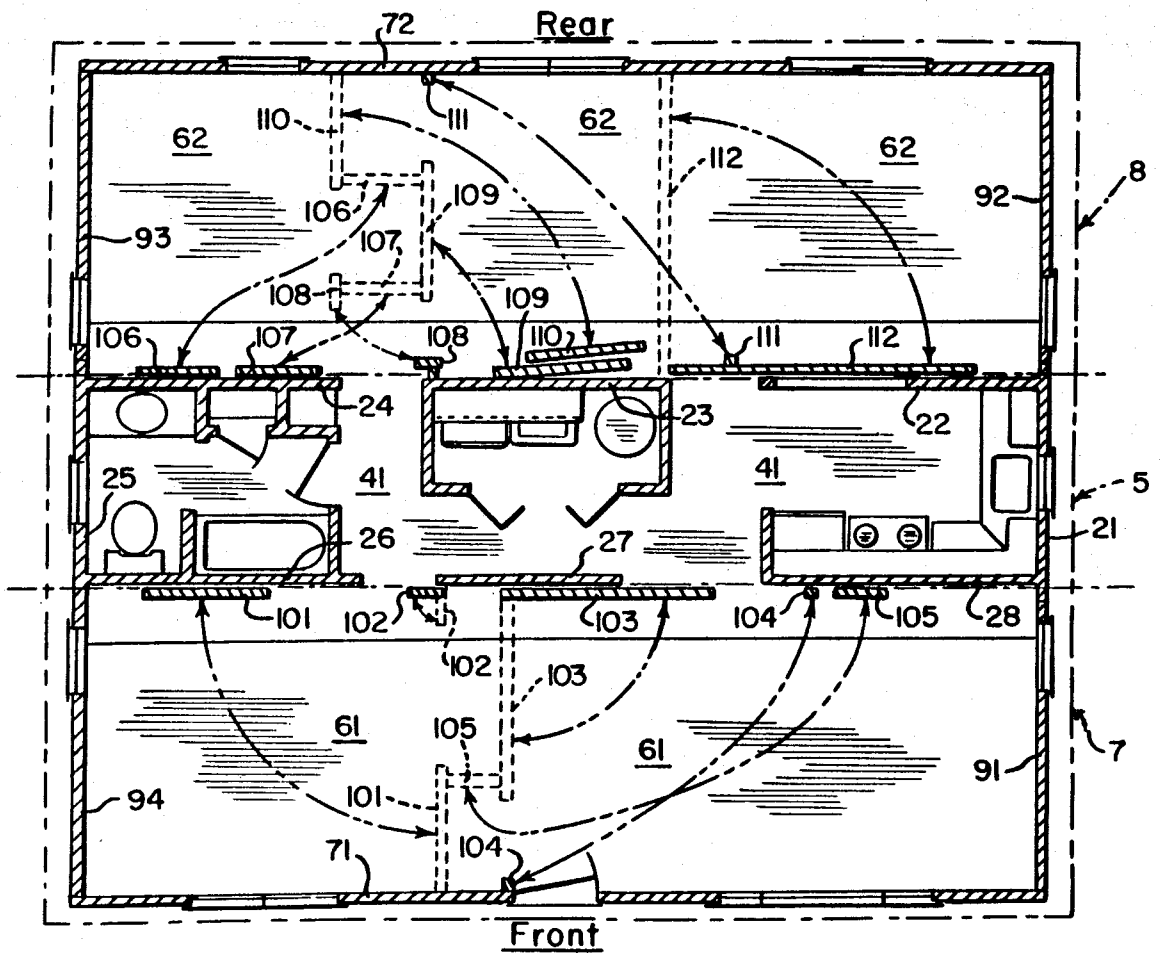
Figure 13:
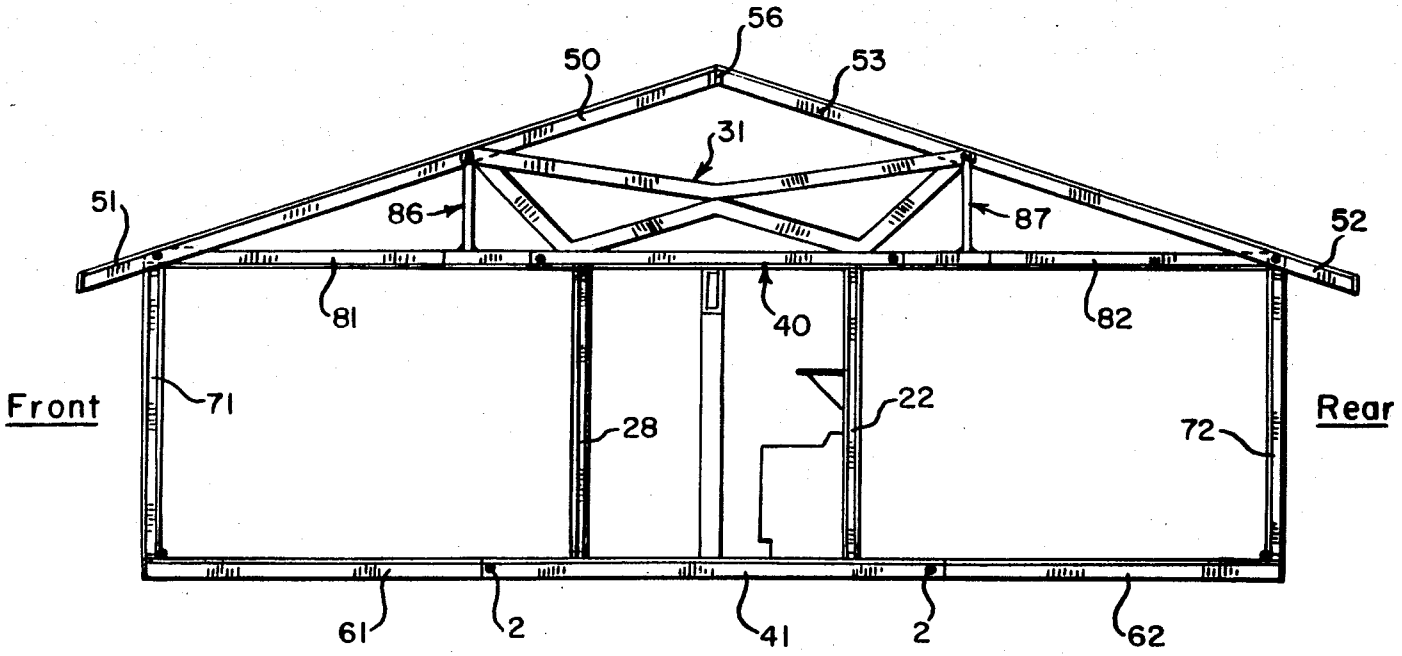
Figure 14:
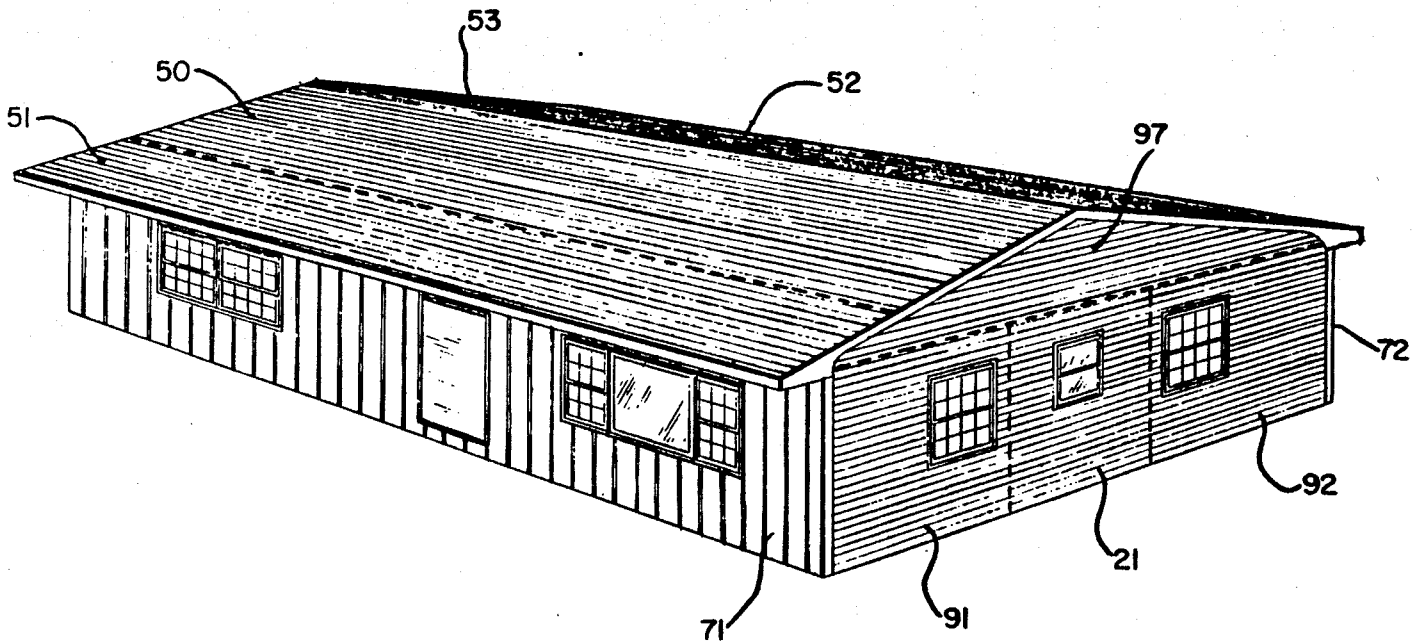
Figure 15:
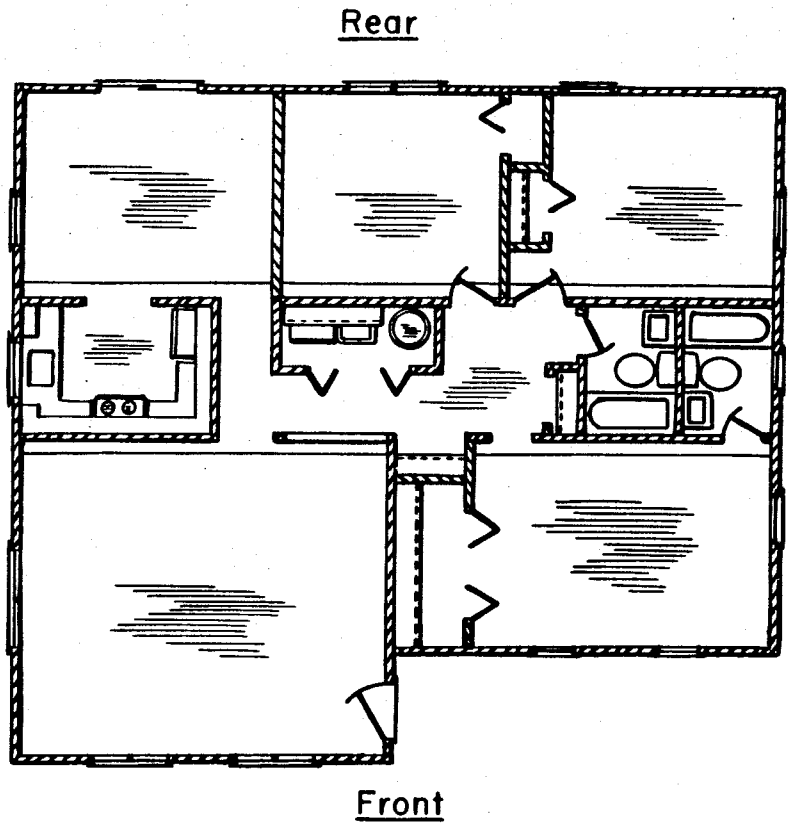
Figure 16:
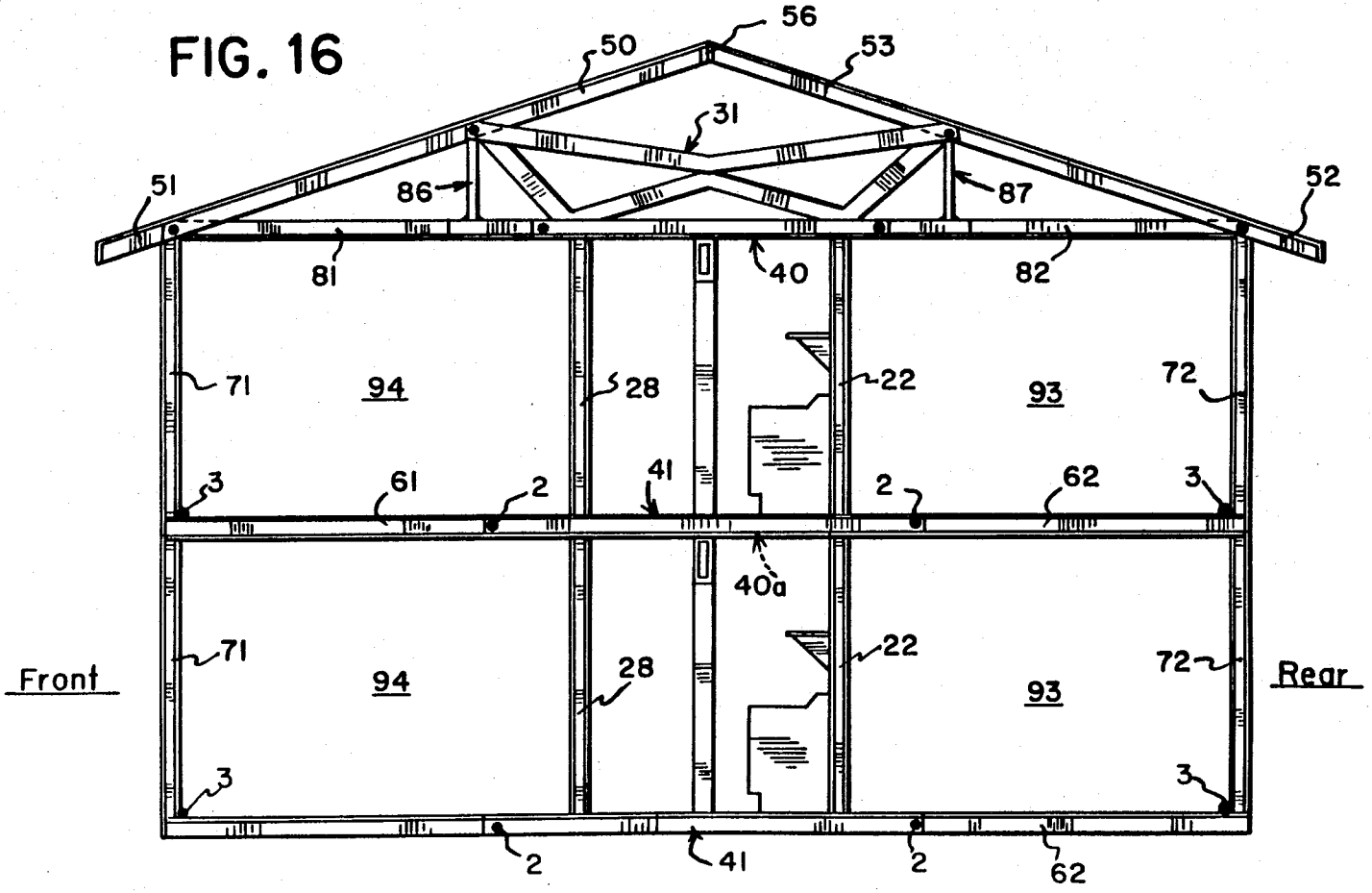

FIG. 5 is a cross-sectional view of one of pivots 4 shown with exterior side walls 92 completely folded and taken through section 5—5 of FIG. 10;

FIG. 6 is a cross-sectional view of applicant's prefabricated folding structure, depicting the pivotal movement of upper folding roof sections 50 and 53, and lower folding roof sections 51 and 52;

FIG. 7 is a cross-sectional view of applicant's prefabricted folding structure, depicting the pivotal movement of folding floor members 61 and 62;

FIG. 8 is a cross-sectional view of applicant's prefabricated folding structure, depicting the pivotal movement of folding front and rear exterior walls 71 and 72, respectively;

FIG. 9 is a partial cross-sectional view of one of pivots 3, shown in a completely unfolded position and taken through section 9—9 of FIG. 11;

FIG. 10 is a plan elevational view of the interior of applicant's prefabricated folding structure, depicting the pivotal movement of folding exterior side walls 91, 92, 93 and 94;

FIG. 11 is a cross-sectional view of applicant's prefabricated folding structure, depicting the pivotal movement of folding ceiling sections 81 and 82 and ceiling support T-braces 86 and 87;

FIG. 12 is a plan elevational view of the interior of applicant's prefabricated folding structure, depicting the positioning of folding interior walls 103 and 112, and free-standing partitions 101, 102 and 104 through 111;

FIG. 13 is a cross-sectional view of applicant's prefabricated structure, shown completely unfolded;

FIG. 14 is an exterior perspective view of applicant's prefabricated structure shown completely unfolded and installed on-site;

FIG. 15 is a plan elevational view of the interior of another structure shown in a completely unfolded position which embodies the present invention and illustrates its use in structures of different shapes; and FIG. 16 is a cross-sectional view of applicant's two story prefabricated structure shown completely unfolded.

To facilitate easy understanding, identical reference numerals are used to denote identical elements common to the figures.

DETAILED DESCRIPTION

Although the teachings of the present invention are applicable to a wide variety of structures of different weight, size, shape and materials for a variety of diverse uses, for purposes of the following description, the present invention will be described in the context of a single-story prefabricated residential dwelling (house).

Figure 1:
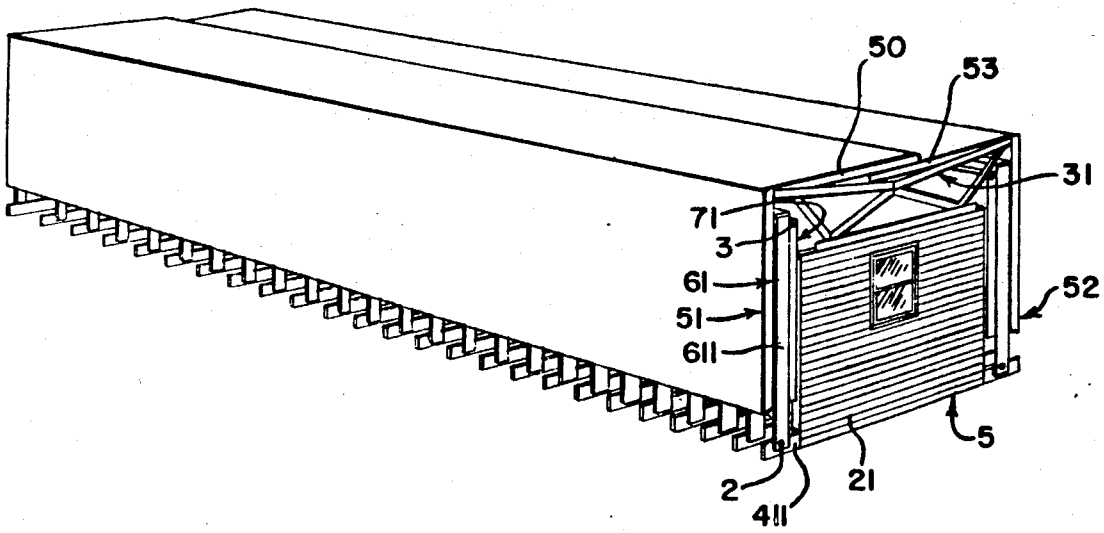

FIG. 1 shows an exterior perspective view of a single-story prefabricated folding house constructed in accordance with applicant's invention and folded in a shipping configuration. As shown, the house contains a generally rectangularly shaped prefabricated central core 5—of which only exterior core wall 21 is shown. Positioned alongside this core wall—and discussed in greater detail in conjunction with FIG. 2—are the folding exterior front and rear walls and folding floor members.

On the left side of the core, each stud comprising folding exterior front wall 71 is pivotedly connected at one of its ends, via pivot 3, to a corresponding end of one of the floor joists, e.g. joist 611, of folding floor member 61. Each of these joints in the folding floor members is pivotedly connected at its other end, via pivot 2, to a respective one of the floor joists, e.g. joist 411, which together comprise the floor of central core. The joists of central core floor 41, illustratively, are 2″×10″ wooden joists and those of each folding floor member are 2″×10″ wooden joists. All the joists comprising each of the floor members are arranged in an approximate 16″ center-to-center spacing and are staggered such that an end of each floor joist in each folding floor member lie adjacent to an end of a corresponding floor joist in the central core. During prefabrication, both subflooring, of illustratively $\frac{5}{8}$″ thick plywood, and final floor covering, of illustratively $\frac{1}{4}$″ hardwood planking, are nailed in place over all the joists comprising each of these floor members with exception of an area existing above pivots 2 between each folding floor member and the core floor. Subflooring and final flooring are installed over this area after the house has been fully unfolded, as discussed hereinbelow.

Affixed atop the central core is a ceiling member (not shown but see FIG. 2) upon which is arranged a plurality of prefabricated roof trusses—of which only truss 31 is shown. These trusses provide support for the folding roof which is comprised of lower folding roof sections 51 and 52 and upper folding roof sections 50 and 53. Each lower roof section is pivotedly connected at one of its ends to both an end of a respective upper folding roof section and to an end of each truss. In the shipping configuration as shown, the lower folding roof sections are pivotedly oriented downward to lie alongside the folding floor members, and the upper folding roof sections are pivotedly oriented downward to lie against each of the trusses.

The use of folding floor, wall, ceiling and roof members, which fold and unfold in a manner to be discussed in detail shortly, reduces the height and width of the folded home to specifically 11 feet 4 inches and 13 feet 8 inches, respectively. Advantageously, this greatly lowers the center of gravity of the folded home. Consequently, this ensures that the house is not susceptible to being tipped over during shipment. Hence, the house can be easily and safely transported on a flatbed truck to a suitable building site.

Once a suitable site has been appropriately excavated and a suitable concrete foundation laid, a well known wood plate (not shown), which is illustratively comprised of a pair of 2″×6″ studs laid one atop another, is affixed all around the top surface of this foundation. Thereafter, this folded house shown in FIG. 1 is positioned on top of the wood plate and unfolded in a manner discussed below.

Figure 2:
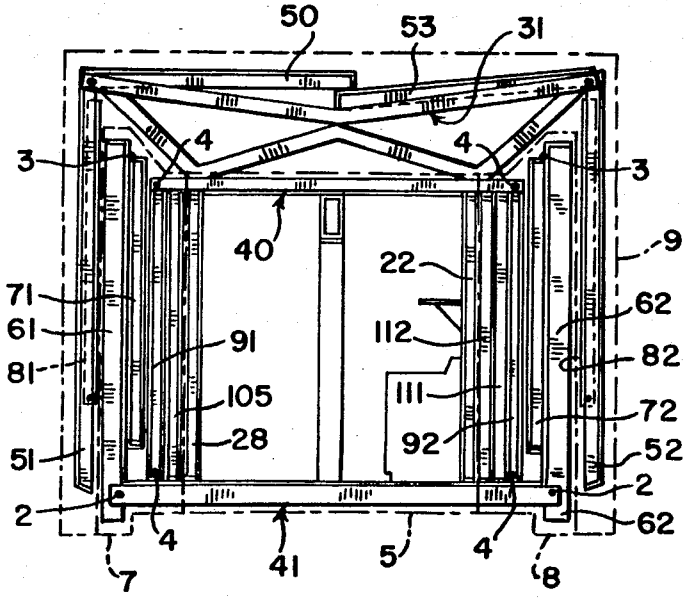

FIG. 2 depicts a cross-sectional detail view of applicant's prefabricated folding house shown in FIG. 1 and taken through a section generally resembling 2—2 of FIG. 10. Viewed in conjunction with FIG. 1 and the interior plan view shown in FIG. 10, FIG. 2 shows that applicant's folding house is comprised of a rectangularly shaped central core 5, a plurality of folding exterior wall members—specifically folding front wall 71, folding rear wall 72 and folding side walls 91, 92, 93 and 94; and folding floor members 61 and 62; folding roof 9 containing folding upper and lower roof section 50 and 53, and 51 and 52, respectively; and folding ceiling members 81 and 82, and lastly a plurality of prefabricated roof trusses of which only truss 31 is shown.

Specifically, central core 5 is comprised of interior core walls 22, 23, 24, 26, 27 and 28, and exterior core walls 21 and 25 all secured, illustratively by nails, to both core floor 41 and ceiling member 40. The central core is completely prefabricated and, as shown in FIG. 10, contains the kitchen including all its appliances; the bathroom—including the necessary plumbing fixtures, noteably a bathroom sink, tub/shower and toilet; and a closet with folding doors containing the hot water heater, washer and dryer.

Each folding exterior wall (front wall 71, rear wall 72 and side walls 91, 92, 93 and 94) is completely assembled during pre-fabrication. Specifically, each wall is fabricated from illustratively 2"×4"×8 foot wooden studs which are approximately spaced 18" apart on a center-to-center basis. During prefabrication, windows are installed into various ones of these walls, and the exterior surface of each folding wall, i.e., that surface which faces the outside environment, is covered with standard ½" plywood sheathing material over which the desired siding material, e.g. aluminum siding, asbestos shingle or other siding material, is applied. In addition, electrical outlet boxes are affixed to various studs in these walls and wired at the factory. To conform with standard building codes, all electrical wiring is placed inside each wall. Thereafter, thermal insulation is installed within each wall and illustratively ½" gypsum board, (also known as "dry wall" or "sheet rock") is then installed over the interior surface of each folding exterior wall, with an appropriately located pre wired electrical outlet.

As previously discussed, all the prefabricated trusses provide necessary structural support for the upper and lower folding roof sections whenever they are pivoted into an open, i.e. unfolded, position. While only one truss 31 is shown in the cross-sectional view of FIG. 2, trusses, each preferably fabricated from 2"×10" rafters and mounted on a 16" center to center spacing. Any number of trusses can be used, with the particular number being predicated upon the desired spacing between trusses and the size of the structure. The spacing for the trusses (and also for the floor joists, wall studs and ceiling rafters) is often specified by local building codes and/or practice and can thus vary from that specified hereinbelow. Each truss is pivotedly attached to upper roof sections 50 and 53, and lower roof sections 51 and 52 of roof 9. These roof sections, with exception of the areas near the peak of the roof and near the pivots between the upper and lower sections as discussed herein, are fully sheathed and shingled during prefabrication.

As shown in FIGS. 2 and 10, a number of structural members, including folding exterior side and front (and rear) walls and a folding floor member, are positioned during prefabrication alongside various interior core walls. Specifically, these structural members are arranged in two groups of similar members, group 7 being adjacent to interior wall 28 and the other, group 8, being adjacent to interior wall 22. In the shipping configuration shown in FIG. 2, the structural members comprising each group are positioned alongside each other and are all substantially parallel to the adjacent interior core wall 22 or 28. Group 7 is comprised of free-standing partition 105, folding exterior side wall 91, folding exterior front wall 71 and folding floor member 61, and also—as is apparent from FIG. 10—folding interior wall 103 and free-standing partitions 101, 102 and 104; and folding exterior side wall 94. Group 8 is comprised of similar structural members and free-standing partitions, specifically: folding exterior side walls 92 and 93, folding exterior rear wall 72, folding floor member 62, folding interior wall 112 and free standing partitions 106 through 111.

1. Folding the Structure

The shipping configuration, shown in FIG. 2, is achieved during prefabrication by first appropriately pivoting the folding interior walls and positioning the free-standing partitions against the core walls and second folding i.e., pivotedly positioning, various structural members inwardly about the central core in the manner described below. Since the structural members comprising group 8 both pivotedly interconnect and fold in a nearly identical manner to those comprising group 7, the following sequence will be described, for the sake of brevity, with respect to only those members in group 7.

First, free-standing partition 105 is positioned, as shown in FIG. 12, alongside interior side core wall 28. This partition is preferably oriented such that its vertical edges are parallel to those of the interior core wall. In a similar fashion, folding interior wall 103 and free-standing partitions 101, 102 and 104 are pivoted or positioned, as shown in FIGS. 10 and 12, such that each lie alongside interior side core walls 26 and 27.

Thereafter, folding ceiling members 81 and 82 are each pivotedly positioned upwardly, as shown in FIG. 11, such that each folding ceiling member, e.g. ceiling member 81, lies partially within and parallel to a corresponding lower folding roof member, e.g. folding roof member 51. The rafters in each folding ceiling member are staggered with respect to those in each corresponding lower folding roof member such that when those ceiling members are folded their joints partially interleave with those in each corresponding lower roof folding section.

Next, as shown in FIG. 10, folding exterior side walls 91 and 94 are pivotedly positioned inwardly, about pivots 4, such that these walls lie alongside free-standing partitions 105 and 101, respectively. Then, as is evident from FIG. 8, folding exterior front wall 71, which pivots, via one of the pivots 3 about an end of floor member 61, is pivotedly positioned downward, such that it lies alongside folding floor member 61.

Thereafter, as shown in FIG. 7, floor member 61 is pivoted upward about pivot 2 located in the left end of core floor 41, such that folding exterior front wall 71, particularly its exterior surface, lies alongside folding exterior side wall 91 (and 94 not shown).

Now, with all the exterior folding walls folded inwardly about the core, upper folding roof section 50 and 53 are folded, as shown in FIG. 6, by being pivotedly positioned downward until each abuts against all the trusses, e.g. truss 31. Lower folding roof sections 51 and 52 are then folded by being pivotedly positioned downward and inwardly such that each lies vertically alongside folded floor members 61 and 62, respectively.

Figure 3:
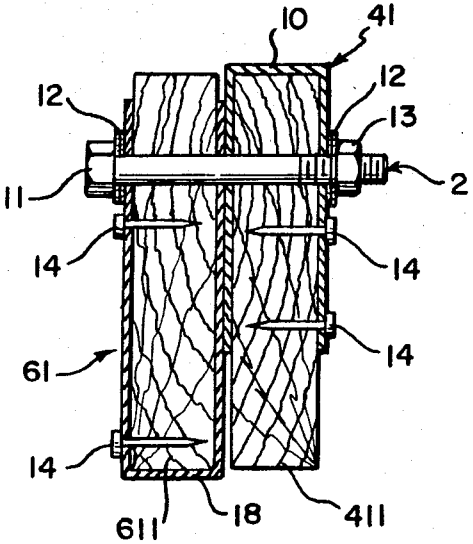

2. Pivots between Folding Structural Members Pivot 2 exists between folding floor members 61 and 62 and core floor 41. This pivot is comprised of a plurality of identical pivotting assemblies, each connecting a floor joist in the central core to a corresponding floor joist in either of the folding floor members. For purposes of illustration, one such pivotting assembly, i.e. that each such existing between floor joist 611 of folding floor member 61 and floor joist 411 of core floor member 41, is shown in FIG. 3.

Specifically, this pivoting assembly is comprised of bolt 11 (illustratively a ½" ASTM A307 bolt) secured by washers 12 and nut 13. Separate saddle straps 10 and 18, each preferably fabricated from galvanized metal 12 gauge or thicker, are each nailed to a floor joists 411 and 611 respectively, in the vicinity of the pivot. These straps provide a sliding interface, against which each joist can rotate without causing any abrasion of either joist. After floor member 611 has been appropriately pivoted into its unfolded position, nut 13 is completely tightened to secure folding floor member 61 in position.

Figure 4:
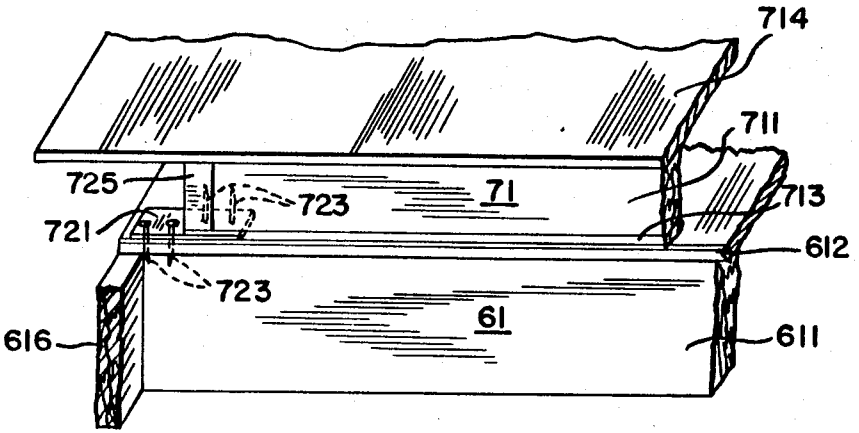

Pivot 3 exists between folding floor member 61 and folding exterior front wall 71 and between folding floor member 62 and folding exterior rear wall 72. This pivot is comprised of a plurality of identical pivotting assemblies, each connected between every joist in a folding floor member and every wall stud in a folding exterior front or rear wall. A partial cross-sectional view of one of these pivotting assemblies, i.e. that existing between floor joist 611 of folding floor member 61 and wall stud 711 of folding exterior front wall 71 is shown in FIG. 4.

Specifically, the pivotting assembly is comprised of a metal plate 721, which is nailed to both floor joist 611 and wall stud 711 by illustratively four nails 723, sized 10 penny (10 *d*) common or larger. Two of these nails are driven through the plate and subfloor 612 into floor joist 611, and the remaining two are driven through the plate and gypsum board 713 into wall stud 711. Whenever exterior front wall 71 is fully pivotted upward into position, as discussed later in conjunction with FIG. 9, exterior front wall 71 is oriented perpendicular to folding floor member 61 and, as a result, metal plate 721 is bent by the pivotting movement of the folding wall with respect to the folding floor into an "L" shape. This plate is advantageously fabricated from galvanized steel or other material that is sufficiently thick, preferably 16 gauge or wider, such that all the plates alone can hold the wall in an upright perpendicular position and also undergo many bending and unbending operations without showing any signs of stress or fracture.

Pivots 4 exist between core ceiling 40 and folding exterior side wall 91 (and 92) and between core floor 41 and folding exterior side wall 91 (and 92). Since all pivots connecting each folding exterior side wall to the core ceiling and core floor are identical, only those involving exterior folding exterior side wall 92 are shown in FIG. 5 for purposes of illustration.

Specifically, FIG. 5 shows exterior side wall 92 in a completely folded configuration. Folding exterior side wall 92 is comprised of a sequence of illustratively standard dimension 2"×4"×8' wooden studs—of which only stud 924 is shown—arranged with approximately 16" center to center spacing and nailed to both upper wall member 923 and lower wall member 925. A layer of sheathing 922 is affixed to the exterior side of the folding wall. For purposes of clarity, the siding that is normally attached at the factory to the outer surface of sheathing 922 has been omitted from this figure. Illustratively, gypsum board 921 is affixed to the interior surface of this wall.

Core floor 41, as shown and as previously discussed, is comprised of illustratively 2"×10" wooden floor joists—of which only floor joists 411 and 413 are shown—all arranged with an approximate 16" center-to-center spacing. Subfloor 414—illustratively $\frac{5}{8}$" plywood sheet—is nailed to the core floor joists. Ceiling member 40 is constructed in a similar manner as is core floor 41, with the exception that gypsum board, specifically sheet 403, instead of $\frac{5}{8}$" plywood as used in the subfloor, is nailed to the under surface of the 2"×8" ceiling joists—of which only joist 402 is shown.

When fully unfolded, exterior side wall 92 lies substantially parallel to exterior core wall 21. This core wall is comprised of a sequence of 2"×4"×8' studs—of which only stud 213 is shown—arranged on an approximate 16" center to center spacing and nailed to both top wall members 211 and 212 and lower wall member 214, all of which are also illustratively 2"×4"×8' wooden studs. Gypsum board 216 is affixed to the interior surface of exterior core wall 21 and sheathing 215 is affixed to the outer (exterior) surface. For purposes of clarity, the exterior siding that is normally affixed to the sheathing has been omitted from this figure.

Exterior folding side wall 92 is pivotedly attached at pivots 4, as shown, to core floor 41 and ceiling member 40 by two nails 49. Each of these nails is sized preferably 16 penny (16*d*) common or larger. One nail is driven through cat block 401 in its upper wall member 923 and the other is driven through cat block 412 into lower wall member 923. Cat block 401 is secured by nails (not shown) to two adjacent ceiling joists—of which only joist 402 is shown. Cat block 412 is secured by nails (not shown) to adjacent floor joists 411 and 412. Consequently, folding exterior side wall 92, rotatably pivots about nails 49.

3. Unfolding the Structure

Having summarily described the sequence in which the folding walls, floor and roof members fold inwardly about the central core to form the folded structure shown in FIGS. 1 and 2, a more detailed explanation will now be given as to the manner in which all the structural members are sequentially unfolded to transform the house from its shipping, i.e., folded, configuration into a fully habitable residential dwelling. This sequence is depicted in FIGS. 6 through 8, and 10 through 12.

The first structural members to be unfolded are the roof sections. As shown in FIG. 6, upper folding roof sections 50 and 53 are pivotedly positioned upward and outward. Ridge beam 56 is preferably a 2"×6" wooden beam which runs the entire length of upper folding roof section 53 and abuts against the top edge of folding roof section 50 when both these roof sections are completely unfolded. The rafters that comprise each of these upper roof sections are 2"×4" wooden beams located on a 16" center-to-center spacing, and all the rafters comprising either of the upper roof sections are staggered with respect to those of the other. Once these upper roof sections are completely unfolded into position as shown in FIG. 6, a pair of suitably sized nails (not shown), preferably 16 penny (16*d*) common or larger, are driven through the ridge beam and into each rafter comprising upper folding roof section 50 in order to fully secure both upper roof sections in position. Thereafter, plywood sheathing is then installed on either side of the peak of the roof. To further weather-proof the peak, appropriate shingles and other well known roofing material are applied over the peak and the plywood sheathing. As noted earlier, the remainder of both upper roof sections have been fully sheathed and shingled during prefabrication.

Next, as shown in FIG. 6, lower roof sections 51 and 52, each comprised of illustratively 2"×6" rafters are pivoted upward and outward into position. Each pivot connecting both the upper and lower roof sections to the trusses, is comprised of a series of $\frac{1}{2}$" bolts (not shown), each of which runs through a rafter in a lower roof section, an adjacent truss and an adjacent rafter in upper roof section. A jack (not shown) is then positioned under the lower end of each of these lower folding roof sections and is adjusted to an appropriate height to temporarily keep each lower roof section in its completely unfolded position. To secure the unfolded roof sections into position, a properly sized nut is threaded into the end of each bolt and then fully tightened. In addition, at least three nails, preferably 16 penny (16*d*) common or larger, are then driven through each rafter in the lower roof section and into its adjacent roof truss, and likewise, three more of these nails are driven through each rafter in the upper roof section and into its adjacent roof truss. Thereafter plywood sheathing, preferably ½ thick, is installed on top of both the upper and lower roof sections in the vicinity of the pivot. Shingles and other roof material and then applied over this sheathing. As previously noted, the remainder of the lower roof sections have been fully sheathed and shingled during prefabrication.

Once the roof is completely unfolded, then as shown in FIG. 7, folding floor member 61 and 62 are pivoted into position. Specifically, both folding floor members are pivoted downward and away from the central core, therby forming the entire floor for the dwelling.

Thereafter, as shown in FIG. 8, folding exterior front and rear walls 71 and 72 are unfolded into position. Specifically, each wall is pivoted upward and outward about pivots 3 until the upper ends of exterior front wall 71 and exterior rear wall 72 abut against all the rafters comprising lower folding roof sections 51 and 52, respectively.

As can be seen in FIG. 9 and as previously noted in conjunction with FIG. 4, the upward movement of folding exterior front wall 71 away from folding floor member 61 causes metal plate 721 to become "L-shaped". Whenever folding exterior front wall 71 is fully unfolded, horizontal stud 725, which exists at the bottom of this wall, lies on top of subfloor 612 of folding floor member 61. In this position, exterior sheathing 714, which is illustratively ½" plywood sheet and which has been attached to this wall during pre-fabrication, overhangs subfloor 611 and end piece 616. This endpiece is nailed to each of the floor joists, by at least 3 nails, preferably 10 penny common or larger, which are all nailed through the sheathing and into the endpiece in the vicinity of each floor joist.

With these folding exterior front and rear walls, secured in place, folding exterior side walls 91, 92, 93, and 94, as shown in the plan view of FIG. 10, are then unfolded into position and secured in place. Specifically, each exterior wall is pivoted outwardly about pivots 4—as previously discussed and shown in FIG. 5—such that each end wall lies substantially perpendicular to the previously unfolded exterior front or rear walls. Once each folding exterior side wall is pivoted into its properly unfolded position, screw nails (not shown but well known) are driven through appropriately positioned cat blocks existing between respective adjacent ceiling rafters and floor joists into the header and lower cross-piece of each of these walls.

At this juncture, folding ceiling members 81 and 82, as shown in FIG. 11, are unfolded into position. To accomplish this, folding ceiling members are pivoted downward such that unfolded ceiling member 81 lies on top of unfolded exterior front wall 71 and side walls 91 and 94; and unfolded ceiling member 82 lies on top of exterior front wall 72 and side walls 92 and 93, respectively.

Next, unfolded exterior front wall 71 is secured to unfolded ceiling member 81 and to lower folding roof section 51. A plurality of "L-shaped" double nailing plates (not shown but well-known) having a saddle shaped lower extension are positioned such that the saddle of each nailing plate straddles the header of folded exterior front wall 71. Each nailing plate has an upward vertically oriented section emanating from one end of the saddle, and is positioned along the header such that its vertical section abuts against one of the rafters in the lower roof section. There are as many nailing plates positioned along the header as there are rafters in this roof section. Once a plate is appropriately positioned, it is nailed to both the header—using preferably at least 6 nails sized 10 penny (10*d*) common or larger, with two nails driven through the saddle of the plate into each side of the header and the remaining two nails driven through the vertically oriented section in the lower roof rafter. To further secure the unfolded exterior front wall to the lower roof section, a bolt (not shown) preferably a ½" ASTM A-307 type, is inserted through a pre-drilled hole existing in the vertical section in each nailing plate and into a corresponding hole in the adjacent lower roof rafter. A ½" nut is threaded onto the end of each bolt and securely tightened. Appropriate size washers may be used with each bolt. Unfolded exterior rear wall 72 is secured to lower folding roof section 52 in a substantially identical fashion.

Since adequate support for the lower roof members is now provided by all the unfolded exterior walls, the jacks that are supporting these lower roof sections are now removed.

Additional support for folding ceiling members 81 and 82 is provided by the installation of a number of "T-braces" as shown in FIG. 11. In the illustrative embodiment shown and described herein, one T-brace, is mounted to a respective upper end of each truss. Since nine trusses are used in the present embodiment, 9 "T-braces" support each ceiling member. While the use of this many braces provides excellent support for each folding ceiling member, fewer braces can be used if desired and consistent with reasonable design practice. Each T-brace extends downward from a side of a upper end of a roof truss and lies in line with a corresponding rafter in a folding ceiling member.

Since all the T-braces are approximately the same, for purposes of illustration, only T-braces 86 and 87 which run between truss 31 and folding ceiling members 81 and 82, respectively, are shown, and only T-brace 86 is discussed. T-brace 86 is comprised of an appropriate length of 2"×4" stud, e.g. stud 861, which extends downward from an appropriate truss to a ceiling rafter, and a relatively short length of 2"×4" stud, e.g. stud 862, which is positioned perpendicularly to stud 861. A nailing plate (not shown but well known), fabricated from galvanized 16 gauge or larger metal sheet and having a saddle at one end and a flat nailing surface at the other, is used to secure the T-brace to the header in ceiling member 81. This plate is positioned to straddle the header such that its flat nailing surface abuts against a side surface near one end (the left end) of stud 862. The plate is then nailed to both the header and T-brace 86 using preferably 6–10 penny (10*d*) common or larger sized nails; four of these nails secure the nailing plate to the header and the other two secure the nailing plate to the brace. In a similar fashion, an identical nailing plate is used to secure the other end of this "T-brace" to a wooden cross-piece existing at the right end of core ceiling 40. Once each "T-brace" is appropriately positioned, it is then secured in position by nails, preferably 16 penny common or larger, driven through its upper end and into the adjacent truss. After all the "T-braces" have been secured, a rectangular sheet of gypsum board, e.g. sheet 863, is nailed to the lower surface of the wooden nailing plates. Each sheet is appropriately sized to both lie flush against the gypsum board previously affixed to the ceiling members during prefabrication and to completely fill in the rectangular opening occurring between the gypsum boards on the underside of each folding ceiling member and the underside of the central core ceiling. All these "T-braces" are completely fabricated during prefabrication of the house and are temporarily stored on the central core floor during shipment of the folded house to the building site.

Once the folding ceiling members have been fully unfolded and secured in position, an enclosed area is defined about this central core. Then, as shown in the plan view of FIG. 12, folding interior walls 103 and 112, and free-standing partitions 101, 102, 104, 105, 106, 107, 108, 109, 110, and 111 are pivoted or moved into respective positions in this area to define both the rooms arranged about the central core and all the closets contained therein. Specifically, folding interior walls 103 and 112 pivot in the same manner as does exterior side wall 92 shown in FIG. 5 and discussed hereinabove. Once the folding interior walls are pivoted into position, then each free-standing partition is appropriately positioned in place. The folding interior walls and partitions are completely framed and covered with gypsum board during prefabrication. Once in position, each of these interior walls and partitions are secured by screw nails to the floor joists in folding floor members 61 or 62, and to the rafters in ceiling members 81 and 82. Specifically, these nails are driven through appropriately positioned cat blocks, existing between certain adjacent rafters in the ceiling (and between certain selected joists in the folding floor members), and into the top (and bottom) horizontal studs comprising each of these interior folding walls and partitions. Advantageously, the use of free-standing partitions, which are positioned during on-site installation, to define room sizes and closets, readily permits changing the dimensions of these rooms and closets at any time up to installation without incurring much, if any, expense. While the doors to each of the closets formed by the free-standing partitions, as well as a number of interior room doors, have all been omitted for the sake of clarity from the plan views shown in the drawing, these doors are attached, i.e. pre-hung, to corresponding free-standing partitions and interior core walls during prefabrication. Advantageously, this further reduces on-site installation time and expense.

As should be readily apparent, applicant's folding prefabricated house is now completely unfolded. A cross-sectional view of it is shown in FIG. 13.

At this stage of installation, the only portion of the dwelling that remains to be enclosed is the attic. To accomplish this, a prefabricated gable end is nailed to the outermost roof rafters and ceiling beams existing at each side of the dwelling. Specifically, each of the two gable ends, of which only gable end 97 is shown in FIG. 14, is triangularly shaped and is comprised of a series of 2"×4" studs (not shown) of appropriate length and mounted apart from each other on an approximate 16" center to center spacing. A layer of sheathing (not shown), preferably ½" plywood, is installed over these studs during prefabrication at the factory. After the gable ends are installed on-site, appropriate siding material, e.g. aluminum or shingle, is applied to the entire side of the house including the gable ends. Applying this type of siding in the field advantageously minimizes the likelihood that any mis-alignment between the siding on the gable ends and that on the rest of the exterior side walls will be visible. If, however, cedar shingles are used for siding, then any minor mis-alignment between the siding attached to the gable ends and that attached to the rest of the exterior side walls is generally not visible. Consequently, this siding material can be applied during prefabrication to both the gable ends and to all the folding exterior side walls in order to further reduce on-site installation time and cost. The prefabricated gable ends, like the prefabricated "T-braces", are temporarily stored in the central core (more specifically by being placed on the floor of the core) while the folded house is being shipped to the building site.

The last remaining stage of installation, namely interior finishing, can now proceed. Specifically, the edges of any interior surfaces of abutting structural members are appropriately taped, spackled and sanded, in preparation for applying final wall covering, e. g. paint, or wallpaper. Thereafter, subflooring and final hardwood floor planking are installed in the previously unfloored areas of the house, i.e. above pivots 4. Alternatively, the entire sub-floors and final floor covering can be installed on-site. While this latter approach slightly increases installation cost, it may be necessary, depending upon the final floor covering chosen by the owner, in order to eliminate any visible gaps or joint lines from appearing in the floor. Thereafter, molding and any remaining interior trim is now installed. At this point, the dwelling has been completely constructed and only requires connection to the local utilities—e.g. electricity and sewerage—for it to be completely habitable.

An exterior perspective view of the dwelling as it stands completely installed and ready for occupancy is shown in FIG. 14.

In the illustrative embodiment described herein, heat is provided through electric baseboard. While electric heat is usually relatively expensive to operate, it is the least expensive to install. Consequently, separate electric baseboard units are installed along the interior bottom edge of various interior core walls and various folding walls. However, to minimize heating costs, a separate thermostat is installed in each room during prefabrication.

Since the weight of a residential dwelling constructed in accordance with the teachings of the present invention, is primarily supported by the walls comprising the central core, this advantageously permits all the folding structural members to be made relatively light. Consequently, this permits each member to be pivoted into position by a few workers without using any heavy machinery. Furthermore, the minimal weight inherent in the structure eliminates the need to incorporate any columns into the structure or to to construct the foundation from reinforced concrete. Consequently, these factors advantageously reduce installation cost.

A floor plan of one of many alternate embodiments of a folding residential dwelling embodying the principles of the present invention is depicted in FIG. 15. As is readily apparent from this figure, the exterior folding front walls are not limited to being co-planar when fully unfolded. As shown, the two walls making up the exterior front wall can be staggered to create a relatively large living room, for example, and also lend a pleasing appearance to the front of the dwelling. In a similar fashion, any of the other folding walls and/or core walls are also not constrained to entirely lie in a single plane but can instead by comprised of a number of staggered or otherwise non-co-planar sections. Moreover, the folding floor and/or ceiling member can also take on many varied non-co-planar geometries to create many diverse and architecturally pleasing layouts. Consequently, a variety of differently shaped structures, including but by no means limited to a simple rectangular layout, can be easily fabricated using the principles of applicants' invention.

While the above folding structure has been completely described in terms of a single-story residential dwelling, it can be readily and inexpensively adapted to multi-story construction. Specifically, to construct a two-story residential dwelling, two folding structures—an upper and a lower—of the type described above are stacked on top of each other. The only difference between these structures is that the lower structure does not contain a folding roof. At the time of on-site installation, the lower structure is first appropriately positioned on the wood plate which forms part of the foundation and is then completely unfolded. All the folding structural members are then secured in position. Then, the upper folding structure, in a completely folded position, is properly positioned directly on top of the lower structure and the folding floor of the upper structure is unfolded into position. All the ceiling rafters of the lower structure thus abut against and are attached, using appropriately sized nailing plates and nails, to all the floor joists comprising both the central core and the folding floor members of the upper structure. The remaining folding structural members of the upper structure are unfolded into position and secured. Appropriate openings have been framed both in the ceiling of the central core of the lower structure and in the core floor member of the upper structure during their prefabrication in order to accommodate a stair case, which was installed in the lower structure during its prefabrication. Any necessary banisters and the like are installed during the final (interior finishing) stage of on-site installation. Unless the two-story dwelling is to be a two family-house, there is little if any need to include any applicances (and/or a hot water heater) in the upper structure. Thus, the area reserved for the kitchen and closet in the central core can be converted into other usable space, e.g. a den or study. As can be readily appreciated by those skilled in the art, multi-story structures in excess of two stories can be easily constructed in a similar manner to that described above. The number of separate folding structures that can be stacked to form the multi-story structure is essentially determined by the weight of each folding structure, and the amount of weight that can be supported by both the foundation and the walls in each folding structure—particularly the lowest in the stack.

While the folding structural members (walls, floors, ceiling and roof members) comprising the folding residential dwelling have been described above as folding and unfolding in a particular sequence it is readily apparent to those skilled in the art that any or all of these structural members can be readily folded and unfolded in a variety of different sequences. The particular sequence is determined by the desired volume of the folded structure and the particular materials used for the folding members and manner in which these members are constructed.

Although particular embodiments have been shown and described herein, a substantial variety of different embodiments of varying sizes and shapes and all incorporating teachings of the present invention may be devised by those skilled in the art without departing from the spirit and scope of the invention.

I claim:

1. A prefarbicated folding structure comprising:

at least one pre-erected central core comprised of at least two oppositely arranged interior walls and a floor extending therebetween, and a plurality of prefabricated structural members including at least one floor section, at least one ceiling section, and at least three exterior wall members, said at least one floor member being pivotedly connected horizontally at one end to said central core floor and pivotedly connected horizontally by a non-articulatable joint at its opposite end to either a folding exterior front wall member, or a folding exterior rear wall member, said wall members being pivotedly connected vertically to an interior wall member on the same side of the central core as the connection of the at least one floor section, so as to form either a compact folded structure, wherein said structural members are pivotedly positioned inwardly about said central core so as to lie in close proximity to and substantially parallel to said corresponding interior wall member, or a sturdy habitable structure, wherein said structural members are pivotedly positioned outwardly from said central core so as to define at least one room arranged adjacent to said central core.

2. The invention in claim 1 wherein said folding structure is further comprised of an integral pivotedly folding roof structure affixed to a ceiling member which is attached to said two oppositely arranged interior wall members, and having a plurality of prefabricated trusses and a plurality of folding roof sections pivotedly mounted thereto.

3. The invention in claim 2 wherein said structural members further comprise:

(a) second folding exterior front and rear walls, (b) a second folding floor section which is pivotedly connected at one end to the opposite end of said central core floor, and pivotedly connected by a non-articulatable joint at its other end to either said folding exterior front wall or said folding exterior rear wall, and (c) a plurality of folding exterior side walls, each is pivotedly connected at a respective end to an interior wall of said central core, said second floor section and folding exterior side walls being connected to the opposite side of said central core than said first floor section and first folding exterior walls.

4. The invention in claim 3 wherein said folding roof structure is comprised of upper and lower folding roof sections, wherein each upper section is pivotedly connected at one of its ends to a corresponding lower section and to an end of at least one of said prefabricated trusses.

5. The invention in claim 4 wherein said central core is comprised of a substantially prefabricated kitchen and a substantially prefabricated bathroom.

6. The invention in claim 5 wherein said prefabricated folding structure is further comprised of a plurality of free-standing partitions which, in said compact folded structure, are positioned substantially parallel to and alongside predetermind ones of interior side walls of the central core, or once said folding structure has been completely unfolded, are positioned to further define said rooms and a plurality of closets arranged about said central core.

7. The invention in claim 6 wherein said compact folded structure is converted into said sturdy, habitable structure according to the following method:

(a) pivotedly positioning said upper and lower folding roof sections such that the ends of at least two of said upper folding roof sections abut against each other, and each of said lower roof sections lies substantialy parallel to said upper roof section to which it is pivotedly connected, (b) pivotedly positioning said folding floor sections such that these sections lie substantially parallel to said floor member in said central core, (c) pivotedly positioning each of said exterior front and rear walls with respect to said folding floor sections, such that each of said walls lies substantially perpendicular to the folding floor section to which it is pivotedly connected, and each of said walls abuts against a lower surface of a corresponding lower folding roof section, (d) pivotedly positioning said folding exterior side walls with respect to said central core such that each side wall lies substantially perpendicular to and abuts against said folding exterior front and rear walls, (e) pivotedly positioning each of said ceiling members until said ceiling member abuts against corresponding exterior side walls and said exterior front or rear walls, 8. The invention in claim 7 wherein said method is further comprised of the steps of appropriately positioning said free-standing partitions to further define said rooms and said closets.

9. A multi-story residential structure having a plurality of prefabricated first folding structures, each of which is vertically positioned with respect to the others, and a prefabricated second folding structure, which is vertically positioned above the uppermost one of said first folding structure, each of said first and second folding structures having at least one prefabricated central core comprised of at least two oppositely arranged interior wall members and a floor, and a plurality of prefabricated structural members including at least one floor section, at least one ceiling section, and at least three exterior wall members, said at least one floor member being pivotedly connected horizontally at one end to said central core floor and pivotedly connected horizontally by a non-articulatable joint at its opposite end to either a folding exterior front wall member or a folding exterior rear wall member, said wall members being pivotedly connected vertically to an interior wall member on the same side of the central core as the connection of the at least one floor section, wherein said structural members are pivotedly positioned inwardly about said central core, so as to lie in close proximity to and substantially parallel to said corresponding interior wall members to define a compact folded structure or are pivotedly positioned outwardly from said central core, so as to define a plurality of rooms arranged about said central core, and said second folding structure is further comprised of an integral pivotedly folding roof structure, which is affixed to the top of a ceiling member attached to said two oppositely arranged interior wall members located within said second folding structure, and has a plurality of prefabricated trusses and a plurality of folding roof sections pivotedly mounted thereto which are pivotedly positioned inwardly about the central core of said second folding structure or are pivotedly positioned outwardly to define the entire roof of said multi-story dwelling.

10. The invention in claim 9 wherein the floor members of both said second folding structure and various ones of said first folding structures abut against the ceiling members of various other ones of said first folding structures.

11. The invention of claim 10 wherein said structural members of each of said first and second folding structures are comprised of:

(a) folding exterior front and rear walls, (b) at least one folding floor section, which is pivotedly connected at one of its ends to a floor member situated in said central core, and is pivotedly connected at its other end to either said folding exterior front wall or said folding exterior rear wall, and (c) a plurality of folding exterior side walls, each of which is pivotedly connected at a respective end to an interior wall which defines said central core.

12. The invention in claim 11 wherein said folding roof structure is comprised of upper and lower folding roof sections, wherein each upper section is pivotedly connected at one of its ends to a corresponding lower section and to an end of at least one of said prefabricated trusses.

13. The invention in claim 12 wherein at least one of said central cores is comprised of a substantially prefabricated kitchen and a substantially prefabricated bathroom.

14. The invention in claim 13 at least one of said folding structures is further comprised of a plurality of free-standing partitions which, are positioned substantially parallel to and alongside predetermined ones of interior side walls of the central core, or once said folding structure has been completely unfolded, are positioned to further define said rooms and a plurality of closets arranged about the central core in that structure.

15. The invention in claim 14 wherein each of said first folding structures is unfolded according to the following method:

(a) pivotedly positioning each of said folding floor sections such that these sections lie substantially parallel to said floor member in said central core of said each first folding structure, (b) pivotedly positioning said exterior front and rear walls with respect to said folding floor sections, such that each of said walls lies substantially perpendicular to the folding floor section to which it is pivotedly connected, (c) pivotedly positioning said folding exterior side walls with respect to said central core until each of said side walls lies substantially perpendicular to and abuts against said folding exterior front and rear walls, (d) pivotedly positioning each of said ceiling members until said ceiling member abuts against corresponding exterior side walls and said exterior front or rear walls, and (e) appropriately positioning said free-standing partitions to define said rooms and said closets arranged about said central core.

16. The invention in claim 15 wherein said second folding structure is unfolded according to the following steps:

(a) pivotedly positioning said upper and lower folding roof sections such that the ends of at least two upper folding roof sections abut against each other, and each lower roof section lies substantially parallel to said upper roof section to which it is pivotedly connected, (b) pivotedly positioning said folding floor sections such that these sections lie substantially parallel to said floor member in said central core of second folding structure, (c) pivotedly positioning said exterior front and rear walls with respect to said folding floor sections, such that each lies substantially perpendicular to the folding floor section to which it is pivotedly connected, and each of said walls abuts against a lower surface of a corresponding lower folding roof section, (d) pivotedly positioning said folding exterior side walls with respect to said central core in said second folding structure until each side wall lies substantially perpendicular to and abuts against folding exterior front and rear walls, (e) pivotedly positioning each of said ceiling members until said ceiling member abuts against corresponding exterior side walls and said exterior front and rear walls, and

17. The invention in claim 16 wherein said method is further comprised of the step of appropriately positioning said free-standing partitions to further define said rooms and said closets arranged about said central core of said second folding structure.

18. A prefabricated folding structure comprising:

at least one pre-erected central core comprised of at least two oppositely arranged interior walls and a floor extending therebetween, and a plurality of prefabricated structural members including at least one floor section, at least one ceiling section, and at least one exterior wall member, said at least one floor member being pivotedly connected horizontally at one end to said central core floor and pivotedly connected horizontally by a non-articulatable joint at its opposite end to said exterior wall member, so as to form either a compact folded structure, wherein said structural members are pivotedly positioned inwardly about said central core so as to lie in close proximity to and substantially parallel to said corresponding interior wall member, or a sturdy habitable structure, wherein said structural members are pivotedly positioned outwardly from said central core so as to define at least one room arranged adjacent to said the central core.

19. The invention in claim 18 further comprising an integral pivotedly folding roof structure affixed to a ceiling member which is attached to said two oppositely arranged interior wall members, and having a plurality of prefabricated trusses and a plurality of folding roof sections pivotedly mounted thereto.

20. The invention in claim 19 wherein said structural members further comprise:

(a) at least one folding exterior wall member;

(b) a second floor section which is pivotedly connected at one end to the opposite end of said central core floor and pivotedly connected by a non-articulatable joint at its other end to said folding exterior wall member and;

(c) a pivotable folding ceiling member.

* * * * *